United States Patent [19]

Brown et al.

[11] Patent Number: 4,941,806

[45] Date of Patent: Jul. 17, 1990

[54] BOTTLED WATER PUMPING APPARATUS

[75] Inventors: Toran S. Brown, Los Angeles; William T. McGregor, Malibu, both of Calif.

[73] Assignee: The McGregor Company, Santa Monica, Calif.

[21] Appl. No.: 283,502

[22] Filed: Dec. 12, 1988

[51] Int. Cl.[5] ..... F04B 49/00

[52] U.S. Cl. ..... 417/38; 417/40; 417/44; 417/53; 62/397; 239/309

[58] Field of Search ..... 417/38, 40, 44, 53; 62/397; 222/185, 205, 325; 239/332, 309

[56] References Cited

U.S. PATENT DOCUMENTS

| | | | |
|---|---|---|---|
| 1,682,502 | 8/1928 | Gusler et al. | 417/40 |
| 2,319,459 | 5/1943 | Johnson | 239/332 |
| 3,269,143 | 8/1966 | Gasparovich | 62/389 |
| 3,796,063 | 3/1974 | Wulke et al. | 62/340 |
| 3,943,727 | 3/1976 | Wade | 62/396 |
| 3,969,909 | 7/1976 | Barto et al. | 62/179 |
| 4,186,419 | 1/1980 | Sims | 417/40 |
| 4,507,054 | 3/1985 | Schoenmeyr | 417/44 |
| 4,597,423 | 7/1986 | Chenot | 222/146.6 X |
| 4,597,509 | 7/1986 | Pereira | 261/157 X |
| 4,815,941 | 3/1989 | Fayo | 62/340 X |

*Primary Examiner*—Leonard E. Smith
*Assistant Examiner*—David W. Scheuermann

[57] ABSTRACT

A bottled water supply system comprises a base unit into which a standard five gallon water bottle may be installed. The cover of the base unit supports the bottle in an inverted position such that the neck of the bottle projects into a water reservoir within the unit. A pump, also housed within the unit, draws water from the reservoir and pumps it to the water supply line of an appliance. Power for the pump is controlled by a pressure actuated switch so that the pressure in the supply line is maintained a predetermined level. A pair of magnetic reed switches are housed within a water tight tube in the reservoir below the normal water level. A magnetic float surrounding the tube actuates one of the reed switches when the water level falls below the neck of the water bottle, thereby actuating an alarm indicating that the bottle is empty. The second switch is actuated just before the water level drops to the level of the pump supply tube and interrupts power to the water pump. The water bottle may include a seal over the neck of the bottle which is left in place on the bottle during installation to prevent spillage. A sharpened tube is disposed within the reservoir so that it will pierce the seal when a fresh bottle of water is installed in the unit.

19 Claims, 4 Drawing Sheets

FIG. 1
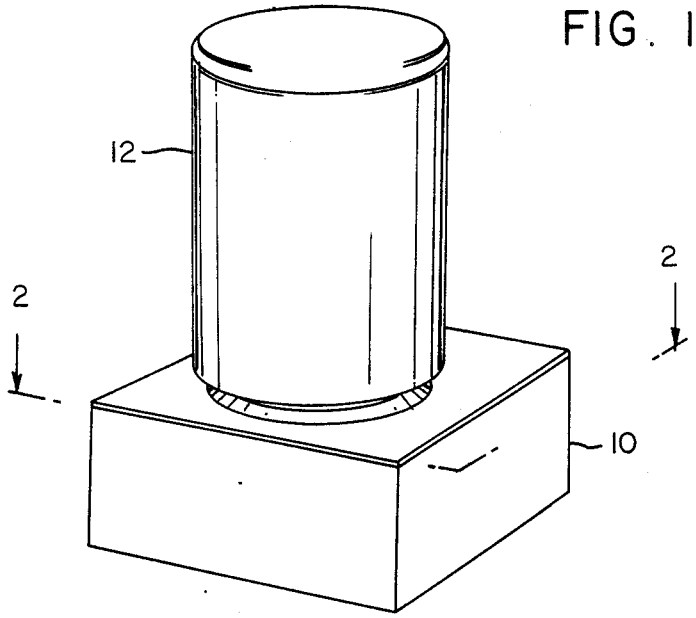
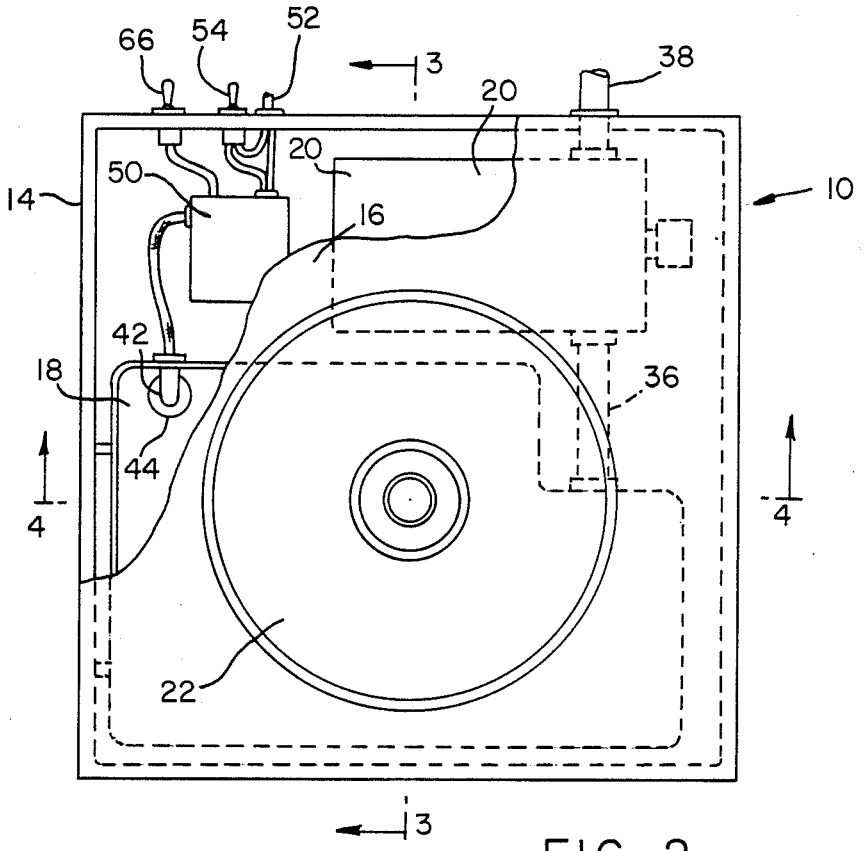
FIG. 2

BOTTLED WATER PUMPING APPARATUS

FIELD OF THE INVENTION

This invention relates to a supply system for bottled water and, particularly, to a system for supplying bottled water to a refrigerator ice maker and similar appliances.

BACKGROUND ART

Due to high levels of impurities found in many domestic water supplies, a substantial number of households prefer not to use their domestic water supplies as a source of drinking water, when making ice, or when making coffee or the like. As a consequence, such households frequently purchase bottled water for such uses. While there are numerous devices for dispensing bottled water for drinking purposes, it is considerably more difficult to supply bottled water to the ice maker or chilled water dispenser of a refrigerator. Typically, a water supply line for a refrigerator is connected directly to the domestic water supply, perhaps with a filter installed therebetween. Thus, if bottled water is to be supplied to a refrigerator, it must be supplied under pressure comparable to that of the domestic water supply system.

Devices for supplying bottled water under pressure to a refrigerator are disclosed in Barto et al. U.S. Pat. Nos. 3,969,909 and 4,027,499. Both of these devices employ a water reservoir that is placed on top of the refrigerator. A water bottle is placed nearby and water is pumped from the bottle into the reservoir. Once water has been pumped into the reservoir, the pump is reconfigured to pump water from the reservoir into the water supply line of the refrigerator and to maintain the supply line at a pressure comparable to the pressure of the domestic water supply.

As mentioned above, the devices disclosed by Barto et al. involve placement of a large water reservoir on top of the refrigerator. When full, this reservoir presents certain hazards as a result of the weight and volume of water thus stored. Should the reservoir develop a leak, water damage to the surrounding area may result. Worse yet, should the reservoir be dislodged, such as by an earthquake, serious injury could result. Such hazards can be mitigated by reducing the volume of water stored in the reservoir, however, this would require that the water in the reservoir be replenished more frequently.

The present invention provides an improved bottled water supply system for refrigerators and other appliances that overcomes these disadvantages of the prior art systems. The features and advantages of the present invention include, for example, the ability to place the device so that, if desired, it is hidden from view. The present invention does not require that there be space between the top of the refrigerator and a cabinet installed thereabove. In this regard, the present invention may be easily used with any type of refrigerator, including those which are "built-in" to the surrounding cabinetry. The present invention also offers advantages over conventional, nonpressurized water dispensing devices since it is not necessary to lift a full bottle of water when replacing the bottle. This not only reduces the physical stress placed on the owner, but also prevents spillage that frequently accompanies the replacement of a water bottle in a conventional cooler or dispenser.

SUMMARY OF THE INVENTION

The present invention comprises a compact unit into which a filled bottle of water, such as a five gallon water bottle, may be installed. The cover of the unit supports the bottle in an inverted position such that the neck of the bottle projects into a water reservoir within the unit. A pump, also housed within the unit, draws water from the reservoir and pumps it to the supply line of the refrigerator or other appliance. Power for the pump is controlled by a pressure actuated switch so that the desired pressure in the supply line is maintained. A pair of level sensing switches are housed within a water tight tube in the reservoir below the normal water level. A float actuates one of the switches when the water level falls below the neck of the water bottle, thereby indicating that the bottle is empty. This switch controls an alarm which indicates that a new bottle should be installed. The second switch is actuated just before the water level drops to the level of the pump supply tube. This switch interrupts power to the water pump, thereby preventing the pump from unnecessarily running dry and possibly damaging the pump.

The water bottle may include a double seal over the neck of the bottle. After removal of the outer seal, a sharpened tube disposed within the reservoir pierces the inner seal when a fresh bottle of water is installed in the unit. In this manner, no spillage can occur until the bottle is in position, at which time the seal on the neck of the bottle is automatically pierced and opened without further intervention.

BRIEF DESCRIPTION OF THE DRAWINGS

FIG. 1 is a perspective view of a water supply system according to the present invention.

FIG. 2 is a partially cut away top plan view of the water supply system shown in FIG. 1.

DETAILED DESCRIPTION OF THE PREFERRED EMBODIMENT

Figure 3:
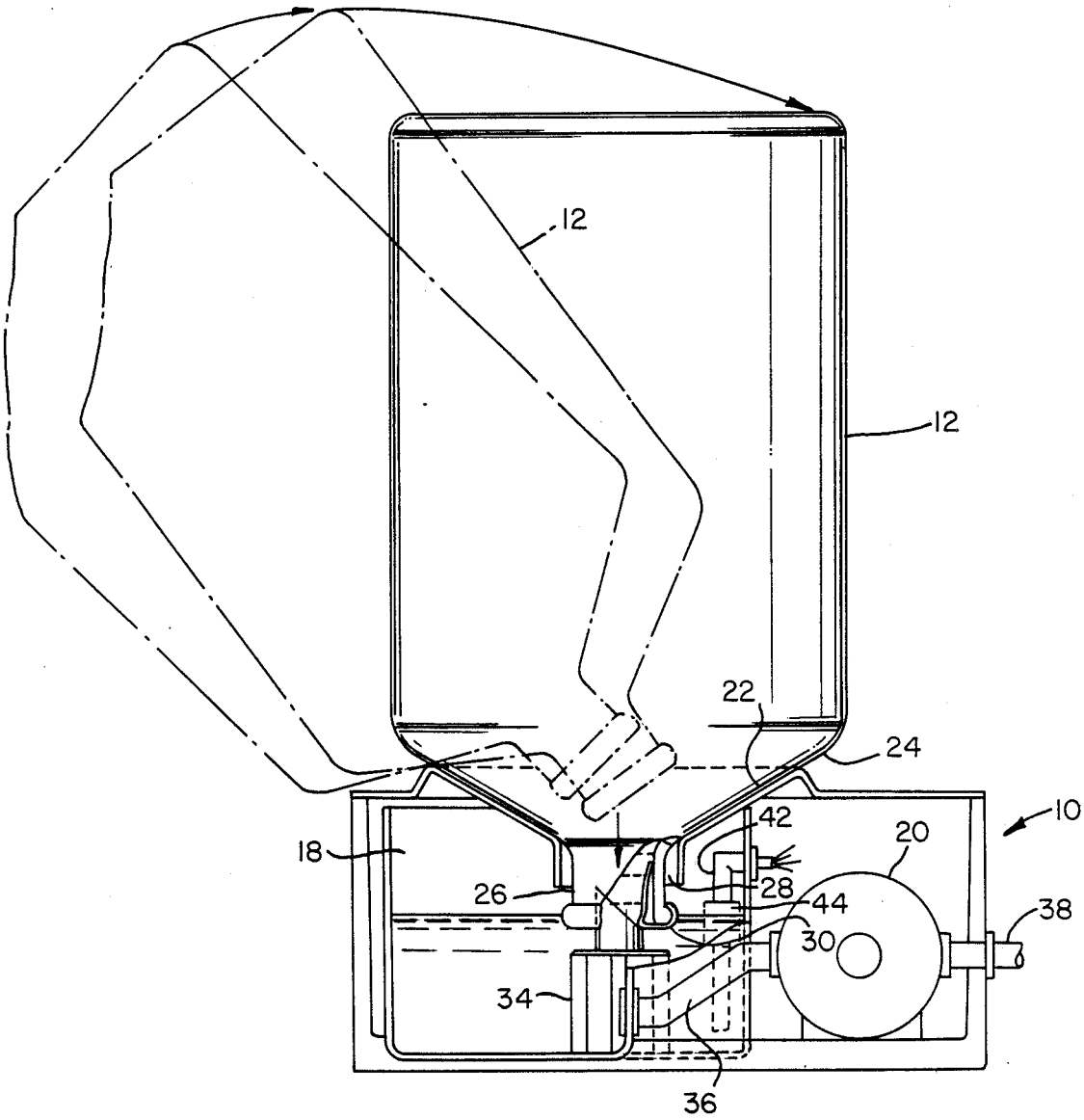
FIG. 3 is a cross sectional view taken through line 3—3 of FIG. 2.
Figure 4:
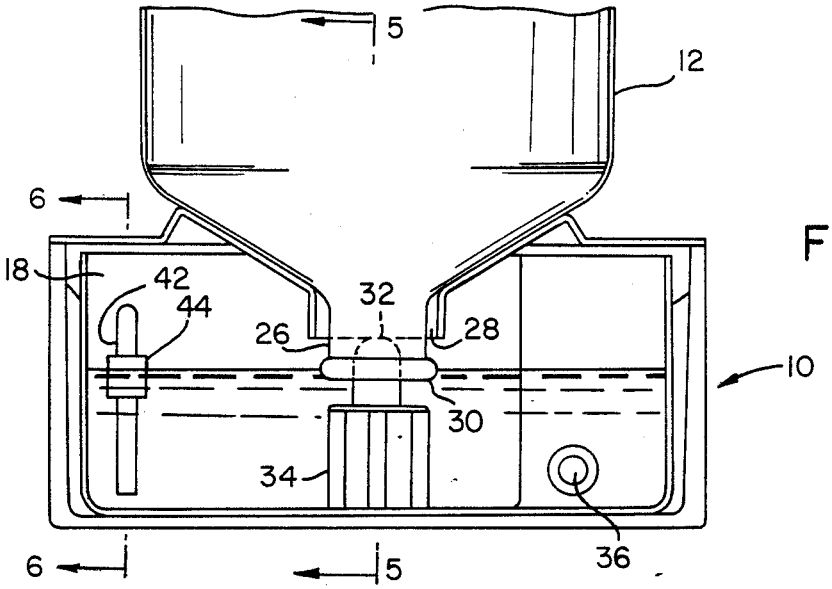
FIG. 4 is a cross sectional view taken through line 4—4 of FIG. 2.
Figure 5:
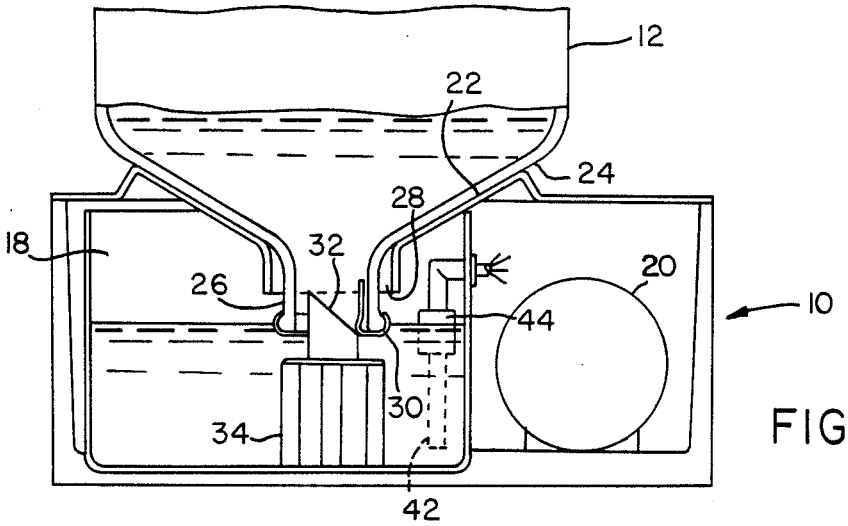
FIG. 5 is a cross sectional view taken through line 5—5 of FIG. 3.

A bottled water supply system for refrigerators and other appliances is disclosed. In the following description, for purposes of explanation and not limitation, specific numbers, dimensions, materials, etc. are set forth in order to provide a thorough understanding of the present invention. However, it will be apparent to one skilled in the art that the present invention may be practiced without these specific details. In other cases, well known electrical devices are shown in block diagram or schematic form so as not to unnecessarily obscure the present disclosure.

Referring to FIGS. 1-6, a bottled water supply system according to the present invention is shown generally by reference numeral 10. Water supply system 10 is designed to employ bottled water such as that contained in bottle 12. Bottle 12 may be any one of many different configurations, but is preferably a five gallon bottle made of either glass or plastic as is commonly provided by suppliers of bottled water for domestic use.

Water supply system 10 comprises a generally rectangular enclosure 14. Enclosure 14 may be made of any suitable material such as plastic or sheet metal so long as it is sufficiently strong to support a completely filled bottle of water such as bottle 12. A cover 16 is provided over enclosure 14 which includes a conical well 22 intended to receive the conical upper surface 24 of bottle 12. Cover 16 is preferably stamped from a sheet material such as stainless steel or molded or formed of a suitable thermoplastic material.

Within enclosure 14, reservoir 18 is positioned generally below conical well 22. Also within enclosure 14, and adjacent to reservoir 18, is pump 20. Pump 20 is in fluid communication with reservoir 18 through pump inlet 36. When bottle 12 is installed on water supply unit 10, neck 26 of bottle 12 protrudes through opening 28 at the bottom of conical well 22. Since bottle 12 is closed except at neck 26, the water level within reservoir 18 is maintained approximately level with the position of neck 26. This level is sufficiently above pump inlet 36 so that a sufficient supply of water is provided to pump 20 until such time as the water within bottle 12 is depleted.

Pump outlet 38 is connected to the water supply line of a refrigerator or other appliance to be provided with bottled water. Examples of other appliances suitable for use with the present invention include coffee makers, drinking water taps, instant hot water dispensers and the like.

Bottle 12 preferably has a double seal over neck 26. Bottle 12 may be sealed in a conventional manner with an additional inner seal 30 over neck 26. Inner seal 30 would be made of a relatively thin material that can be easily punctured by a sharp object, but which will otherwise maintain its integrity against normally encountered hydrostatic pressure. Bottle 12 would typically have the conventional outer seal (not shown) that would protect inner seal 30 from puncture and maintain its cleanliness until such time as bottle 12 is installed in unit 10. Inner seal 30 protects the contents of bottle 12 from contamination prior to installation and also prevents spillage as bottle 12 is tilted into position. Alternatively, inner seal 30 may be the conventional bottle seal, and an outer seal (not shown) may be provided to protect the inner seal 30 and the neck 26 of the bottle from dust and contamination while the bottle is in storage awaiting use. In either case, the neck region, including seal 30, is maintained in a clean and sterile condition so that contamination or impurities are not introduced into reservoir 18 when a new bottle is installed. Of course, the present invention may also be used with only a conventional single seal, in which case it would be advisable to carefully clean the seal and neck region of the bottle prior to installing it in unit 10. If desired, bottle 12 may be installed in unit 10 without any seal attached, however, this increases the likelihood that water will splash onto the top of unit 10 and the surrounding area.

An angle cut tubular member 32 is positioned within reservoir 18 on support 34 so as to puncture seal 30 when bottle 12 is seated in conical well 22. By orienting the sharp tubular member as shown, the seal is not only punctured when the bottle is placed in position, but it will also be cut or torn open to provide water in the volume demanded by the pump, all without creating any loose pieces of the seal o debris that might accumulate in the reservoir and/or interfere with the pump or level switch operation. The tubular member itself may be a short piece of stainless steel tube on an appropriate pedestal molded into the reservoir or a hard plastic member as desired.

It is intended that unit 10 will be placed on the floor in proximity to a refrigerator or other appliance to be supplied with bottled water, or in some other convenient location, such as a lower shelf or floor of a cabinet or storage area in the vicinity. In that regard, a simple slide out shelf could be used to better facilitate the replacement of the water bottle if desired. For example, if bottled water is to be supplied to appliances approximately co-located with a sink, unit 10 may be conveniently located in the cabinet area beneath the sink. Such placement allows a filled bottle 12 to be slid into position adjacent to the front of unit 10. Bottle 12 can then be tipped over directly into conical well 22 as illustrated in FIG. 3. This facilitates installation of bottle 12 in unit 10 without need for lifting bottle 12. This is particularly advantageous for persons who would have difficulty lifting a full five gallon water bottle.

Figure 6:
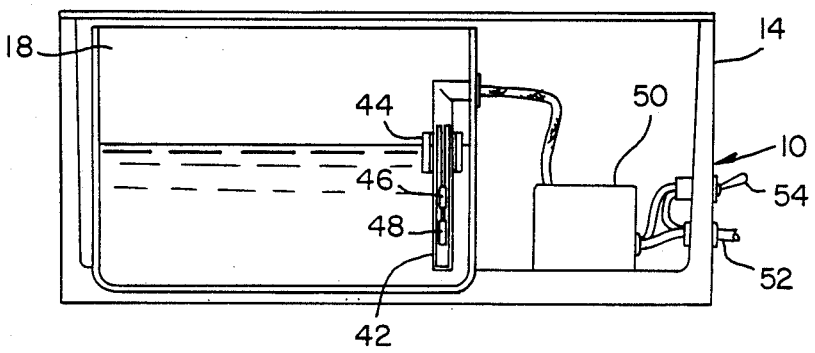
FIG. 6 is a cross sectional view taken through line 6—6 of FIG. 3.

As best seen in FIG. 6, in the preferred embodiment a water tight tube 42 extends within the interior of reservoir 18, with cylindrical float 44 encircling tube 42. A magnet is secured within float 44 near the center of buoyancy thereof, and level sensing switches, such as magnetic reed switches 46 and 48, are positioned within tube 42. Switch 46 is positioned slightly below the level of neck 26 of bottle 12 and, therefore, slightly below the normal water level within reservoir 18. When the supply of water within the reservoir is depleted, continued use of water provided by unit 10 will cause the water level within reservoir 18 to drop, bringing float 44 into operative alignment with switch 46. At such time, switch 46 is actuated by the magnet disposed within float 44 to sound an intermittent audible alarm indicating the need to install a fresh bottle of water.

Switch 48 is positioned somewhat below switch 46 but above pump inlet 36. Should the water level within reservoir 18 continue to drop, switch 48 will be actuated prior to the time that the water falls below the pump inlet. Actuation of switch 48 interrupts the power supply to pump 20, thereby insuring that pump 20 will not pump when water inlet 36 is dry.

Figure 7:
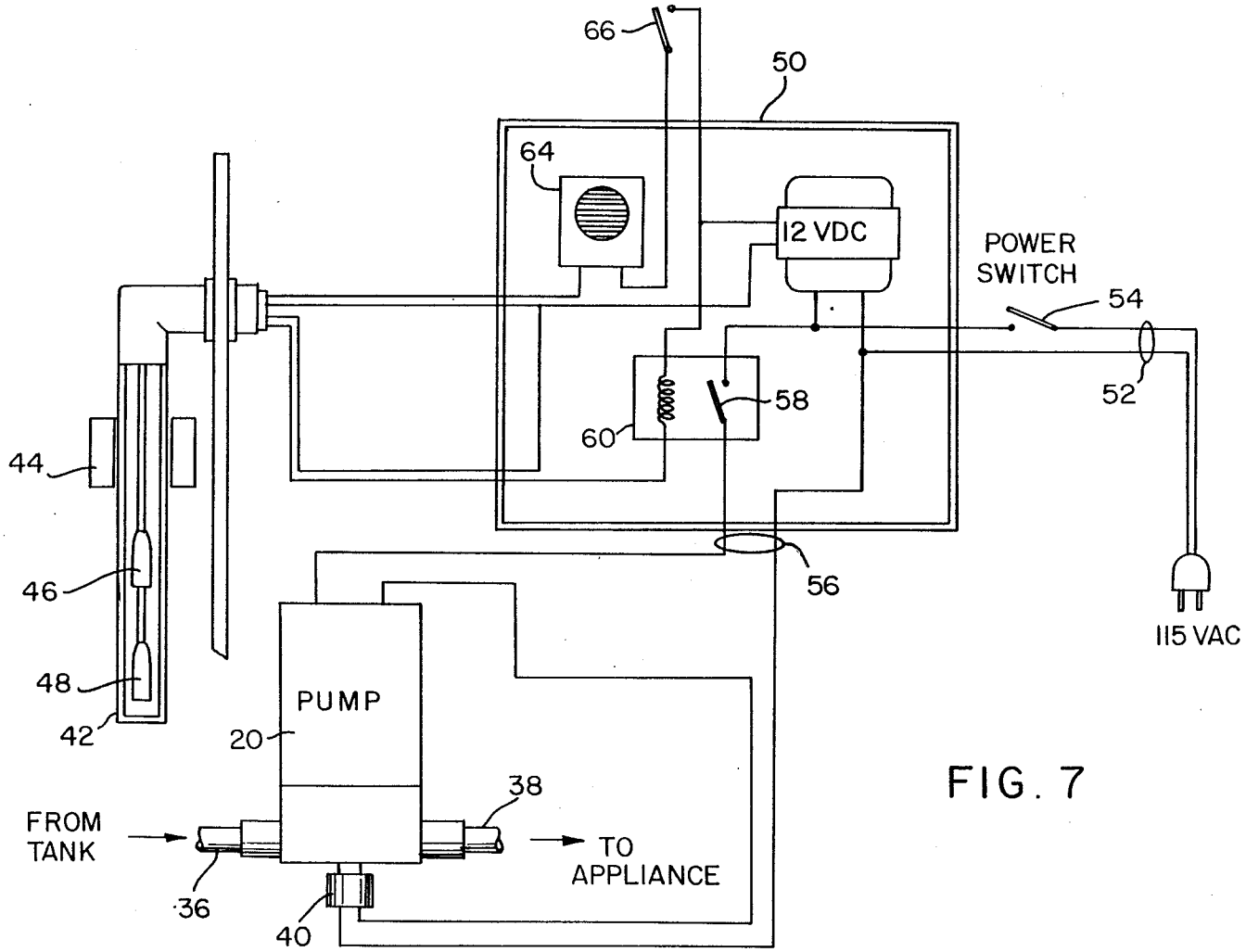
FIG. 7 is a schematic block diagram of the present invention.

FIG. 7 presents an electrical schematic diagram of the present invention. Most of the electrical components are housed within enclosure 50 which, in turn, is installed within enclosure 14 as shown in FIG. 6. Input power is provided by power cord 52 from any convenient wall outlet supplying 115 Volts AC. A power switch 54 is provided on the side of enclosure 14. Power is supplied to pressure switch 40 which senses the water pressure at pump outlet 38. Whenever the pressure in pump outlet 38 falls below a predetermined level, pressure switch 40 is actuated, thereby causing power to be applied to pump 20 until pressure within pump outlet 38 is restored to the predetermined value. Power for pump 20 is connected across normally closed contact 58 of relay 60. Relay 60 is controlled by reed switch 48 so that power to pump 20 is interrupted when the water level within reservoir 18 falls below a predetermined level as explained above.

Transformer/rectifier 62 is of conventional design and provides a source of 12 Volts DC for the coil of relay 60 and for audible alarm 64. Audible alarm 64 is disposed within enclosure 50 and is energized by reed switch 46 as discussed previously. Alarm 64 preferably sounds intermittently so as to provide a positive indication that replacement of the water bottle is required without being unduly obtrusive. Alternative types of audible or visible alarms may be employed as a matter of design choice. A switch 66 is provided on the side of the enclosure 14 to deactivate alarm 64 if desired. Deactivation of alarm 64 will not pose a significant hazard since pump 20 is still protected by level switch 48 which controls relay 60.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

We claim:

1. An apparatus for supplying bottled water from a bottle to an appliance comprising:

a unitary assembly for location at an elevation below the elevation at which bottled water is to be supplied to the appliance;

a reservoir for holding water, said reservoir being located adjacent the bottom of said assembly;

a motor driven pump that has an inlet communicating with the water in said reservoir, said pump having an outlet communicating with said appliance;

a water pressure sensitive switch in communication with said pump outlet, said switch being set to connect said motor to a source of electricity for starting the motor and pump automatically when the water pressure in said pump outlet falls below a predetermined value; and a bottle support disposed above said reservoir for receiving said bottle and supporting said bottle in an inverted position such that said reservoir is partially filled with water from said bottle.

2. The apparatus of claim 1 further comprising an enclosure for said reservoir, said pump and said water pressure sensitive switch and wherein said bottle support comprises a cover for said enclosure having a conical well therein.

3. The apparatus of claim 1 further comprising water level sensing means for sensing the level of water within said reservoir.

4. The apparatus of claim 3 wherein said water level sensing means comprises a first level sensing switch disposed at a first predetermined level within said reservoir.

5. The apparatus of claim 4 further comprising alarm means coupled to said first level sensing switch for signaling an alarm when the water level in said reservoir drops to said first predetermined level.

6. The apparatus of claim 3 wherein said water level sensing means comprises a second level sensing switch disposed at a second predetermined level within said reservoir.

7. The apparatus of claim 6 further comprising pump shut off means coupled to said second level sensing switch for disconnecting said pump from said source of electricity when the water level in said reservoir drops to said second predetermined level.

8. The apparatus of claim 3 wherein said water level sensing means comprises a float having a magnet disposed thereon and constrained to move substantially vertically in accordance with the level of water in said reservoir, and at least one magnetic reed switch disposed within said reservoir adjacent to the path of said float, whereby said reed switch is actuated when said float is in vertical proximity thereto.

9. The apparatus of claim 7 wherein said second predetermined level is lower than said first predetermined level.

10. The apparatus of claim 7 wherein said pump shut off means comprises a relay.

11. The apparatus of claim 1 further comprising seal puncturing means for puncturing a seal covering a neck of said bottle as said bottle is placed within said bottle support.

12. The apparatus of claim 11 wherein said seal puncturing means comprises a sharpened tubular member supported within said reservoir substantially concentric with said neck of said bottle when said bottle is placed within said bottle support.

13. An apparatus for supplying water to an appliance comprising:

a unitary assembly for location at an elevation below the elevation at which bottled water is to be supplied to the appliance;

a bottle containing water;

a reservoir for holding water, said reservoir being located adjacent the bottom of said assembly;

a motor driven pump that has an inlet communicating with the water in said reservoir, said pump having an outlet communicating with said appliance;

a water pressure sensitive switch in communication with said pump outlet, said switch being set to connect said motor to a source of electricity for starting the motor and pump automatically when the water pressure in said pump outlet falls below a predetermined value;

a first water level sensing means disposed at a first predetermined level in said reservoir for signaling an alarm when the water level in the reservoir drops to said first predetermined level;

a second water level sensing means disposed at a second predetermined level in said reservoir below said first predetermined level for disconnecting said pump from said source of electricity when the water level in said reservoir drops to said second predetermined level, said second predetermined level being above said inlet for said motor driven pump; and a base having a cover, said cover including a bottle support disposed above said reservoir for receiving said bottle and supporting said bottle in an inverted position such that said reservoir is partially filled with water from said bottle.

14. The apparatus of claim 13 wherein said first and second water level sensing means comprise a float having a magnet disposed thereon and constrained to move substantially vertically in accordance with the level of water in said reservoir, and at least two magnetic reed switches disposed within said reservoir adjacent to the path of said float, whereby each said reed switch is actuated when said float is in vertical proximity thereto.

15. The apparatus of claim 13 wherein said second water level sensing means includes a relay.

16. The apparatus of claim 13 wherein said bottle includes a seal to prevent spillage of the water contained therein.

17. The apparatus of claim 16 further comprising seal puncturing means for puncturing said seal of said bottle as said bottle is placed within said bottle support.

18. The apparatus of claim 17 wherein said seal puncturing means comprises a sharpened tubular member supported within said reservoir substantially concentric with said neck of said bottle when said bottle is placed within said bottle support.

19. A method of supplying bottle water to an appliance comprising the steps of:

providing a reservoir for holding water below the elevation the water is to be supplied to the appliance;

installing a bottle of water in an inverted position over said reservoir so that said reservoir is partially filled with water from said bottle;

providing a motor driven pump that has an inlet communicating with the water in said reservoir and an outlet communicating with said appliance;

sensing water pressure in said outlet of said pump;

pumping water from said inlet to said outlet when the water pressure in said pump outlet falls below a predetermined value so that water is automatically pumped from said reservoir as water is drawn from said outlet by said appliance;

signalling an alarm when the water in said reservoir drops to a first predetermined level;

removing electrical power to said motor driven pump when the water in said reservoir drops to a second predetermined level below said first predetermined level, said second predetermined level being above the inlet for said motor driven pump, whereby an alarm will be initiated when the water level reaches said first predetermined level and electrical power to said motor driven pump will be interrupted when the water in said reservoir drops to a second predetermined level, all before said pump will run dry.

* * * * *

UNITED STATES PATENT AND TRADEMARK OFFICE

CERTIFICATE OF CORRECTION

PATENT NO. : 4,941,806

DATED : 7/17/90

INVENTOR(S) : Brown, et al

It is certified that error appears in the above-identified patent and that said Letters Patent is hereby corrected as shown below:

Col. 03, line 67 delete "o" insert --or--.

Signed and Sealed this

Twenty-seventh Day of April, 1993

*Attest:*

MICHAEL K. KIRK

*Attesting Officer*

*Acting Commissioner of Patents and Trademarks*